US010603556B2

(12) United States Patent
Pearson et al.

(10) Patent No.: US 10,603,556 B2
(45) **Date of Patent: *Mar. 31, 2020**

(54) HOCKEY-STICK BLADE WITH TAILORED PERFORMANCE REGIONS

(71) Applicant: Bauer Hockey Ltd., Blainville (CA)

(72) Inventors: Robert T. Pearson, Van Nuys, CA (US); Michael Lloyd Snow, Winnetka, CA (US); Michael Mountain, Northridge, CA (US)

(73) Assignee: Bauer Hockey, LLC, Exeter, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/194,571

(22) Filed: Nov. 19, 2018

(65) Prior Publication Data

US 2019/0083865 A1 Mar. 21, 2019

Related U.S. Application Data

(63) Continuation of application No. 15/903,463, filed on Feb. 23, 2018, now Pat. No. 10,195,505, which is a continuation of application No. 15/012,690, filed on Feb. 1, 2016, now Pat. No. 9,914,033, which is a continuation of application No. 13/963,848, filed on Aug. 9, 2013, now Pat. No. 9,248,356.

(51) Int. Cl.

| | |
|---|---|
| ***A63B 59/70*** | (2015.01) |
| ***A63B 60/00*** | (2015.01) |
| *A63B 102/22* | (2015.01) |
| *A63B 102/24* | (2015.01) |

(52) U.S. Cl.

CPC ..... *A63B 59/70* (2015.10); *A63B 60/00* (2015.10); *A63B 2102/22* (2015.10); *A63B 2102/24* (2015.10)

(58) Field of Classification Search

CPC ..... A63B 59/70; A63B 2102/24
USPC ..... 473/560–563
See application file for complete search history.

(56) References Cited

U.S. PATENT DOCUMENTS

| | | | |
|---|---|---|---|
| 2,774,596 | A | 12/1956 | Bredenbert |
| 4,076,240 | A | 2/1978 | Haddad |
| 5,050,878 | A | 9/1991 | Deleris |
| 5,407,195 | A | 4/1995 | Tiitola et al. |
| 6,019,691 | A | 2/2000 | Hilborn |

(Continued)

FOREIGN PATENT DOCUMENTS

CA 2037273 A1 8/1992

OTHER PUBLICATIONS

Sep. 15, 2015—(CA)—Requsition by the Examiner—App 2858269.

(Continued)

*Primary Examiner* — Mark S Graham
(74) *Attorney, Agent, or Firm* — Banner & Witcoff, Ltd.

(57) ABSTRACT

A hockey-stick includes a blade and a shaft. The blade includes a heel region, a toe region spaced longitudinally from the heel region, and a mid-region located between the heel region and the toe region. The blade optionally also includes a hosel to which the shaft is attached. One or more tuning rods or similar structures are positioned in the blade to increase the blade's stiffness to substantially match the stiffness of the shaft. The tuning rods are optionally located in the mid-region of the blade and may extend into the hosel and, in some cases, into the shaft or the toe region.

18 Claims, 4 Drawing Sheets

(56) References Cited

U.S. PATENT DOCUMENTS

| | | | | |
|---|---|---|---|---|
| 6,062,996 | A | 5/2000 | Quigley et al. | |
| 6,916,261 | B2 * | 7/2005 | Cullen | A63B 59/00 473/563 |
| 7,097,577 | B2 | 8/2006 | Goldsmith et al. | |
| 7,144,343 | B2 | 12/2006 | Goldsmith et al. | |
| 7,294,072 | B2 | 11/2007 | Montecchia | |
| 7,326,136 | B2 | 2/2008 | Jean et al. | |
| 7,914,403 | B2 | 3/2011 | Ie | |
| 7,963,868 | B2 | 6/2011 | McGrath et al. | |
| 8,608,597 | B2 | 12/2013 | Avnery et al. | |
| 8,677,599 | B2 | 3/2014 | Gans | |
| 9,248,356 | B2 * | 2/2016 | Pearson | A63B 60/00 |
| 9,914,033 | B2 * | 3/2018 | Pearson | A63B 60/00 |
| 10,195,505 | B2 * | 2/2019 | Pearson | A63B 59/70 |
| 2003/0004019 | A1 | 1/2003 | Lussier et al. | |
| 2009/0005198 | A1 | 1/2009 | Shiu | |
| 2009/0054180 | A1 | 2/2009 | Garcia | |
| 2010/0323830 | A1 | 12/2010 | Blotteaux et al. | |
| 2011/0237365 | A1 | 9/2011 | McGrath et al. | |
| 2013/0116070 | A1 | 5/2013 | Xun et al. | |
| 2013/0172135 | A1 | 7/2013 | Jeanneau | |
| 2014/0057746 | A1 | 2/2014 | Jeanneau | |
| 2014/0148279 | A1 | 5/2014 | Villar et al. | |

OTHER PUBLICATIONS

Reebok Product information for "20K Sickick Accublade", 2012 (dowloaded from Internet Sep. 17, 2013 at http://reebokhockey.com/en/gear/player/sticks/20k-sickick).

Apr. 14, 2014—(PCT) International Search Report and Written Opinion—App PCT/US2012/071510.

Nov. 13, 2019—(CA) Examiner's Report—App. 2,989,666.

* cited by examiner

HOCKEY-STICK BLADE WITH TAILORED PERFORMANCE REGIONS

CROSS-REFERENCE TO RELATED APPLICATIONS

This application is a continuation of U.S. patent application Ser. No. 15/903,463, filed Feb. 23, 2018, which is a continuation of Ser. No. 15/012,690, filed Feb. 1, 2016, which is a continuation of U.S. patent application Ser. No. 13/963,848, filed Aug. 9, 2013 and now U.S. Pat. No. 9,248,356, issued Feb. 2, 2016, which are incorporated herein by reference.

BACKGROUND

Composite hockey-stick blades typically are constructed by wrapping fiber-reinforced plies over one or more core elements to create a hockey-stick blade pre-form. The blade pre-form is then placed within an external mold where resin, which is either pre-impregnated in the fiber plies or added via a resin-transfer process, is cured. An expansion bladder within the blade pre-form, or one or more heat-expanding core elements, may be used to provide internal pressure to mold the blade into the shape of the external mold. The curing process hardens the resin so that the fibers become disposed within a hardened resin matrix, while the mold defines the exterior shape of the cured blade (which sometimes is integrally molded with a hockey-stick shaft).

Composite hockey stick shafts are commonly offered in varying degrees of stiffness or in various "flexes" to meet the needs of players with different abilities and skill sets. Depending on the height, weight, or strength of a given player, for example, the player may choose a relatively stiff shaft or a more flexible shaft to enhance his or her shot-making or stick-handling skills. The stiffness properties of the blades used with these various shafts, however, do not vary. Rather, blades with identical stiffness properties are commonly used on a variety of shafts having different stiffness properties.

SUMMARY

A hockey-stick includes a blade and a shaft. The blade includes a heel region, a toe region spaced longitudinally from the heel region, and a mid-region located between the heel region and the toe region. The blade optionally also includes a hosel to which the shaft is attached. One or more tuning rods or similar structures are positioned in the blade to increase the blade's stiffness to substantially match the stiffness of the shaft. The tuning rods are optionally located in the mid-region of the blade and may extend into the hosel and, in some cases, into the shaft or the toe region.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the various views.

DETAILED DESCRIPTION OF THE DRAWINGS

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

Figure 1:
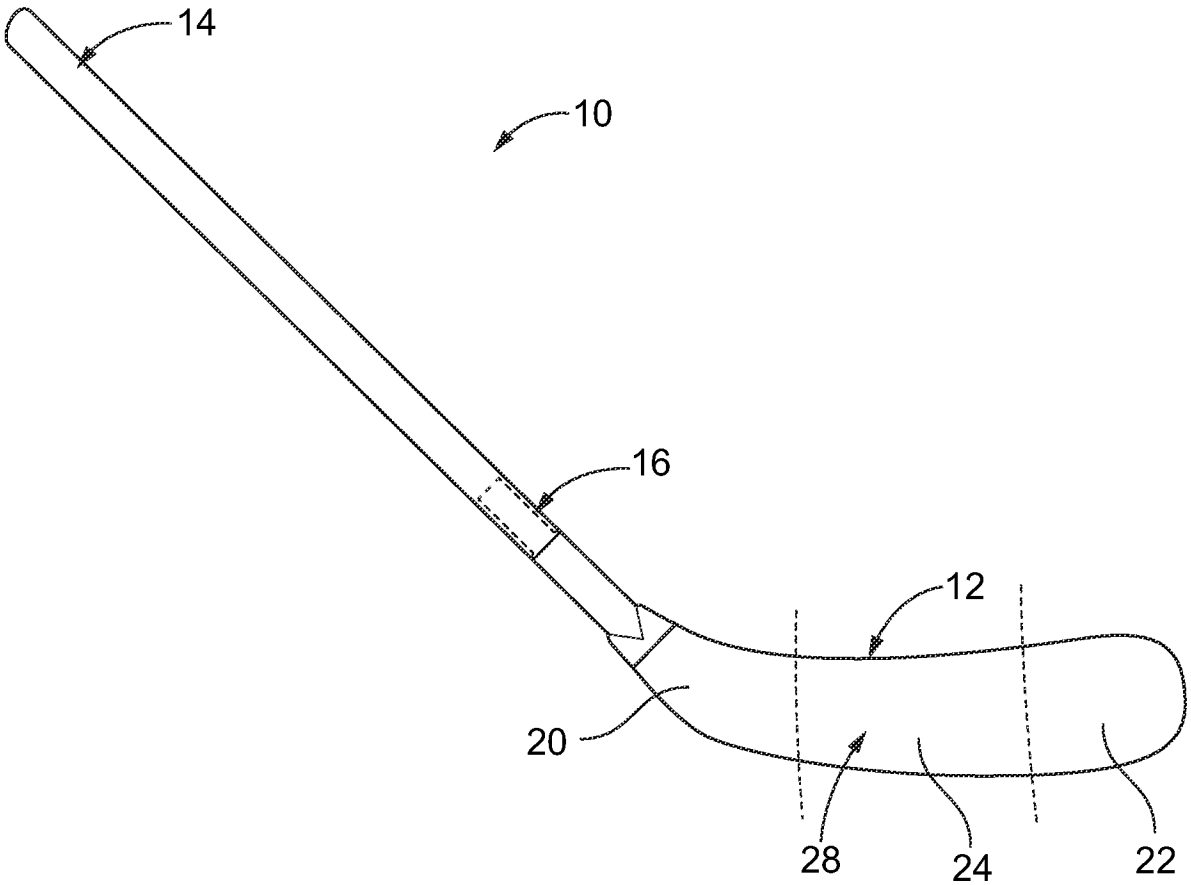
FIG. 1 is a perspective view of a hockey stick according to one embodiment.
Figure 2:
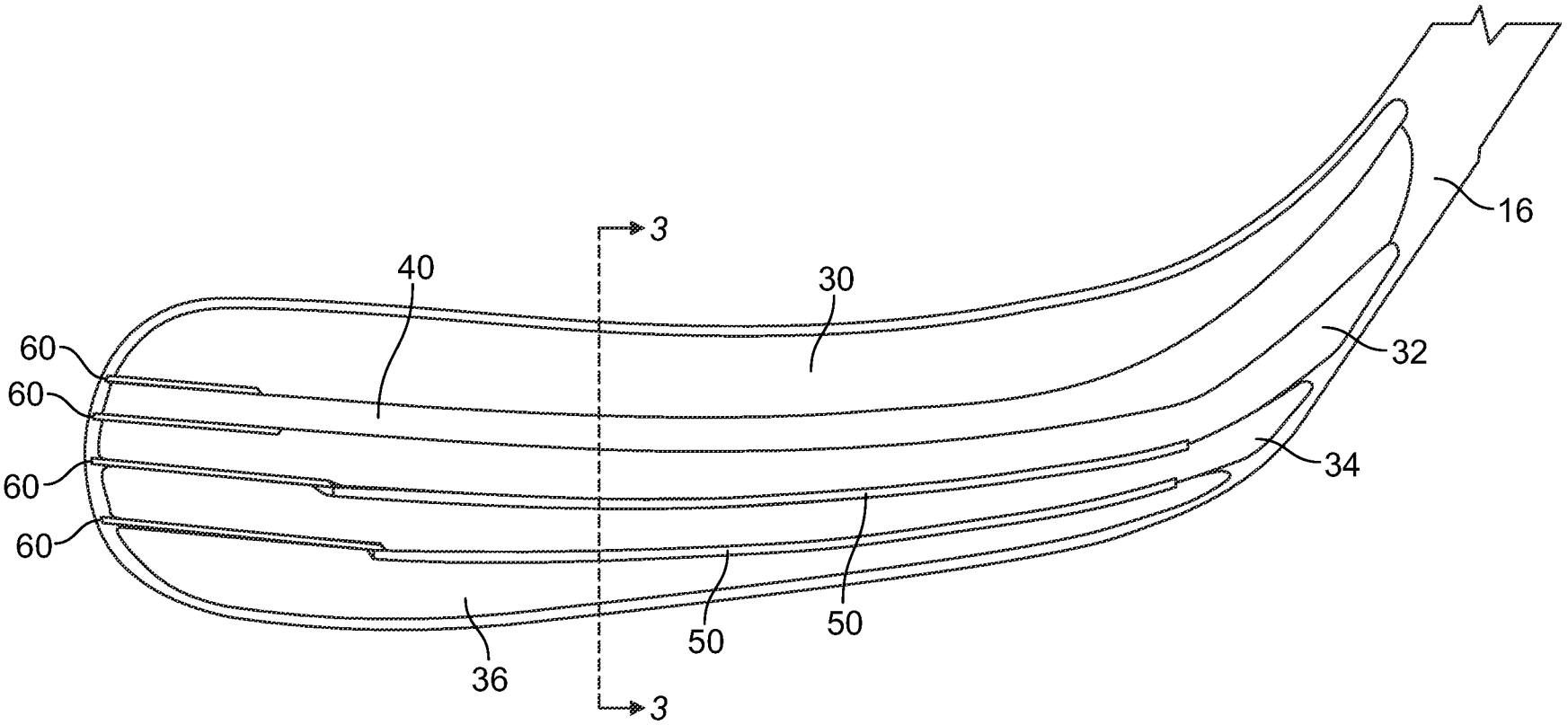
FIG. 2 is a partial-perspective view of a hockey-stick blade with the external plies omitted to highlight internal features of the blade, according to one embodiment.
Figure 3:
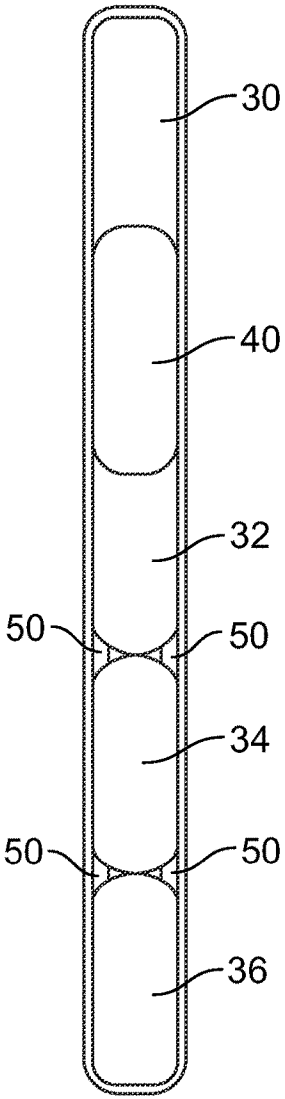
FIG. 3 is a sectional view taken along Section 3-3 of FIG. 2.

Turning now in detail to the drawings, as shown in FIGS. 1-3, a hockey stick 10 includes a blade 12 and a shaft 14. The blade 12 may be detachable from the shaft 14 at its upper end, or it may be permanently or integrally attached to the shaft 14. For example, the blade 12 and the shaft 14 may be molded together to form a one-piece stick.

The joint between the blade 12 and the shaft 14 may be formed by a hosel 16 or tenon at the upper-end of the blade 12 that is received within a socket in the lower end of the shaft 14. Any other suitable connections between the blade 12 and the shaft 14, including those disclosed in U.S. Pat. Nos. 7,097,577 and 7,144,343, for example, which are incorporated herein by reference, may be used. The blade 12 and shaft 14 may be constructed in any suitable manner, using any suitable materials, such as by those methods and materials described in incorporated U.S. Pat. Nos. 7,097,577 and 7,144,343, while further incorporating one or more of the additional features described herein.

The blade 12 generally includes the upwardly extending hosel 16 and three regions arranged in a longitudinal direction along the length of the blade: a heel region 20, a toe region 22, and a mid-region 24 located between the heel region 20 and the toe region 22. As described in detail below, one or more of these regions may be tailored to provide enhanced performance and feel characteristics throughout the blade, as well as to substantially match the global stiffness of the blade 12 to that of the shaft 14.

The blade 12 includes a front face (not visible in the figures) and a rear face 28 separated in a lateral direction by a cavity. The cavity may be filled with one or more core elements made of foam, elastomeric materials, or one or more other suitable materials, such as those described in incorporated U.S. Pat. Nos. 7,097,577 and 7,144,343. The core elements are wrapped in one or more fiber-reinforced plies, such as plies reinforced with carbon, aramid, boron, glass, or other suitable materials, such as those described in incorporated U.S. Pat. Nos. 7,097,577 and 7,144,343.

In the embodiment illustrated in FIG. 2, the interior of the blade 12 includes four core elements 30, 32, 34, 36 generally running from the toe region 22 to the heel region 20 of the blade 12. Any other suitable number of core elements may alternatively be used. In other embodiments, for example, a single core element may be used. An air bladder 40 optionally is included in the blade 12. In the illustrated embodiment, the air bladder 40 is located between the uppermost core elements 30 and 32 but could be located in another suitable location.

The blade 12 is initially constructed to be softer or more flexible than typical existing blades. This may be accomplished by increasing the ratio of softer fibers to harder fibers, such as by increasing the number of glass fibers and decreasing the number of carbon fibers relative to typical existing blades, or by orienting the fibers to yield a relatively lower stiffness.

One or more tuning rods 50 are then added to the blade construction to increase the blade's stiffness to substantially match the flex of a given shaft 14. The tuning rods 50 may be made of a rolled composite material, such as carbon, aramid, boron, glass, or other suitable materials, or of a metal material, or of any other material suitable for adding stiffness to the blade. Cured or uncured rods may be designed in various geometries, such as flat panels, rods, tubes, stacks, or other suitable configurations. Thus, the term "tuning rod" is used herein to describe stiffening elements of a variety of possible shapes and materials.

In one embodiment, a blade designed for adult play is initially constructed to have a flex that substantially matches the flex of a 65-flex shaft (i.e., a shaft that requires 65 pounds of force to bend the shaft one inch). One or more tuning rods 50 are then added to increase the blade's stiffness to substantially match the flex of a given shaft 14, such as a shaft having a 75, 85, 100, or 110 flex, which are the most common adult-shaft flexes. The blade 12 could be designed to have any other suitable initial flex (for example, a 45-flex as a starting point for a junior stick), after which tuning rods 50 may be added to increase the blade's flex to match any shaft flex above the blade's initial flex.

In one embodiment, the tuning rods are positioned on one or more surfaces of one or more of the core elements. The tuning rods 50 may be bonded to the core elements with an adhesive or other bonding material, or they may be co-cured with the overall blade structure.

In the embodiment illustrated in FIGS. 2 and 3, a first tuning rod 50 is positioned along a front face of the core elements 32, 34 where their edges meet, and a second tuning rod 50 is positioned along a rear face of the core elements 32, 34 where their edges meet. Similarly, a third tuning rod 50 is positioned along a front face of the core elements 34, 36 where their edges meet, and a fourth tuning rod 50 is positioned along a rear face of the core elements 34, 36 where their edges meet.

Figure 5:
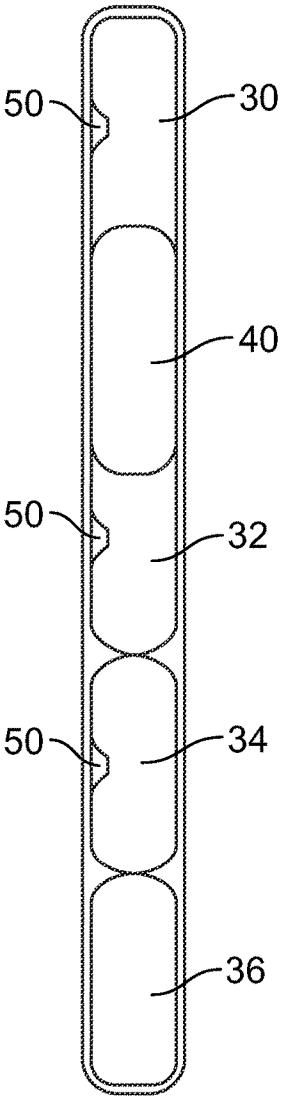
FIG. 5 is a sectional view taken along Section 5-5 of FIG. 4.
Figure 4:
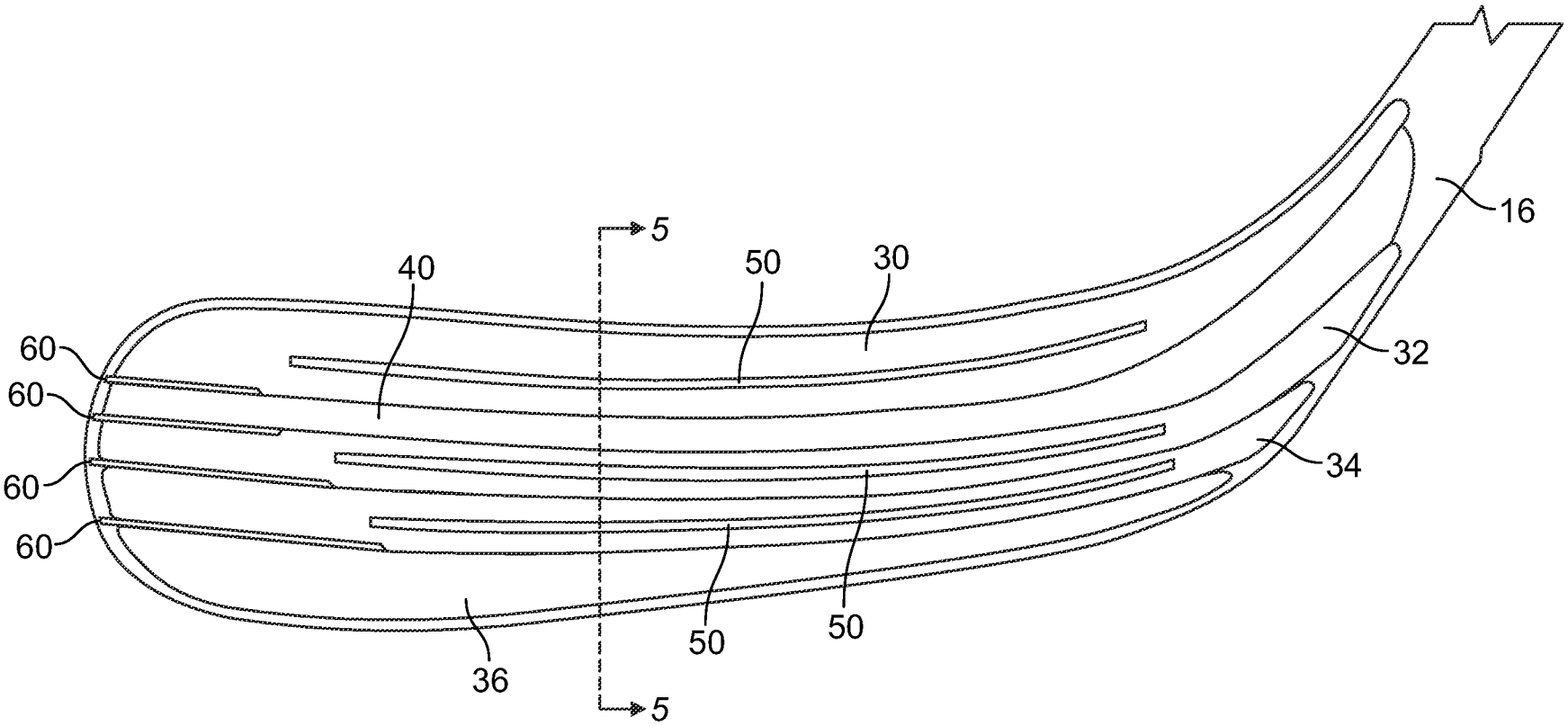
FIG. 4 is a partial-perspective view of a hockey-stick blade with the external plies omitted to highlight internal features of the blade, according to another embodiment.

In the embodiment illustrated in FIGS. 4 and 5, tuning rods 50 are positioned along the front faces of generally vertically central regions of core elements 30, 32, and 34. In other embodiments, one or more of the tuning rods 50 may be omitted, or additional tuning rods 50 may be added. For example, the tuning rod 50 on the front face of core element 30 may be omitted such that there are only two tuning rods 50 in the blade 12 that are positioned in a generally vertically central region of the blade 12. In another embodiment, one or more tuning rods 50 may be positioned along generally vertically central regions of both faces of one or more core elements. In another embodiment, tuning rods 50 may be positioned between adjacent core elements.

While the tuning rods 50 in the illustrated embodiments are shown as being generally parallel to the longitudinal direction of the blade 12, one or more tuning rods 50 could alternatively be oriented in other directions to achieve a desired stiffness profile. For example, one or more tuning rods 50 may be oriented at approximately plus or minus 30° or 45° relative to the longitudinal direction of the blade 12 to achieve a desired blade stiffness.

The optimal size, length, number, orientation, and positioning of the tuning rods 50 is generally dictated by the one or more materials used to construct the rod 50, the initial stiffness of the blade 12, the stiffness of the shaft 14 to which the blade will be attached, and so forth. For example, while one or more tuning rods 50 typically will be located in at least a portion of the mid-region 24 of the blade 12, they may also extend into the hosel 16 and, in some cases, into the shaft 14. In this manner, tuning rods 50 may be used to add stiffness to the shaft 14, as well.

The tuning rods 50 may also extend into the toe region 22 of the blade 12 to provide additional stiffness in the toe region 22. Alternatively or additionally, the toe region 22 may include reinforcing elements 60 wrapped around at least portions of one or more of the core elements 30, 32, 34, 36, as described in U.S. patent application Ser. No. 13/688,061 (the '061 application), filed Nov. 28, 2012, which is incorporated herein by reference. These reinforcing elements 60 may be used to distribute the stiffness in the toe region 22 in a desired manner, as described in the '061 application. In the illustrated embodiments, tuning rods 50 are located in the mid-region 24 and heel region 20 of the blade 12, while reinforcing elements 60 are located in the toe region 22 of the blade 12.

By adding one or more tuning rods 50 to a relatively flexible blade 12, the stiffness of the blade 12 can be tailored (optionally throughout its entire length) to match the stiffness of a shaft 14 to which the blade will be attached. This blade tuning results in a better feeling stick for many players, as well as improved shot control and stick-handling control. Further, by matching the flex of the blade 12 with the flex of the shaft 14, the hockey stick 10, which essentially acts as a spring, can better transfer energy to a puck or ball.

Blade stiffness may be further tuned by adjusting the fiber angles in the composite plies wrapped around the core elements 30, 32, 34, 36. For example, blade stiffness may be increased by orienting a greater percentage of the fibers in the longitudinal direction of the blade, or decreased by orienting a greater percentage of the fibers from the bottom to the top of the blade. In one embodiment, for example, the core elements 30, 32, 34, 36 may each be wrapped in a first ply including carbon fibers oriented at approximately 30° relative to the lateral direction between the front and rear blade faces, and a second ply including carbon fibers oriented at approximately −30° relative to this lateral direction. In another embodiment, the core elements 30, 32, 34, 36 may be wrapped in a first ply including carbon fibers oriented at approximately 45° relative to the lateral direction, and a second ply including carbon fibers oriented at approximately −45°, 0°, or 90° relative to the lateral direction. Any other desired combination of fiber angles may alternatively be used.

The two plies in these exemplary constructions optionally may be combined into a single "sandwich ply," in which the first ply is ironed to—or otherwise attached to or merged with—the second ply. A greater or lesser number of plies may be wrapped around each of the core elements 30, 32, 34, 36, depending on the thickness of the core elements, the thickness of the plies, or the stiffness and flexibility goals of a given blade design.

Once the core elements are wrapped in fiber-reinforced plies, and the tuning rods 50 are positioned in the blade layup, one or more face plies may be wrapped around or otherwise applied to the front and rear surfaces of the wrapped core elements to form a blade pre-form structure. Once the blade pre-form structure is completed, the blade may be cured using a bladder-molding process, a compression-molding process, or in any other suitable manner, such as by those methods described, for example, in incorporated U.S. Pat. Nos. 7,097,577 and 7,144,343.

Any of the above-described embodiments may be used alone or in combination with one another. Further, the hockey stick or hockey-stick blade may include additional features not described herein. While several embodiments have been shown and described, various changes and substitutions may of course be made, without departing from the spirit and scope of the invention. The invention, therefore, should not be limited, except by the following claims and their equivalents.

What is claimed is:

1. A blade for a hockey stick, the blade comprising:
a toe portion;
a heel portion;
a cavity; and
an intermediate portion between the toe portion and the heel portion of the blade in a longitudinal direction of the blade;
wherein the blade comprises a metal element disposed at least in the intermediate portion of the blade;
wherein the metal element is positioned on a core element;
wherein the metal element extends in a longitudinal direction of the blade; and
wherein the metal element comprises a flat metal panel oriented at an angle of 30° to 45° relative to a longitudinal direction of the hockey-stick blade.

2. The blade of claim 1 further comprising: a front surface and a rear surface opposite one another, wherein the cavity is between the front surface and the rear surface of the blade.

3. The blade of claim 1 wherein the metal element extends for less than a length of the cavity in the longitudinal direction of the blade.

4. The blade of claim 1 wherein the blade further comprises a plurality of metal elements.

5. The blade of claim 1 wherein the metal element extends from the heel portion to the toe portion of the blade.

6. The blade of claim 1 wherein the metal element is bonded to the core element with an adhesive or other bonding material.

7. The blade of claim 1 wherein the metal element is co-cured with a remainder of the blade.

8. The blade of claim 1 wherein the metal element is spaced from a top edge of the blade and a bottom edge of the blade.

9. The blade of claim 8 wherein the metal element is disposed in a central region of the blade in a vertical direction of the blade and spaced from a top edge and a bottom edge of the blade.

10. The blade of claim 1 wherein the metal element is configured to increase a stiffness of the blade.

11. The blade of claim 1 wherein the metal element is configured increase the stiffness of the blade to substantially match the stiffness of a shaft.

12. The blade of claim 1 wherein the metal element is a tuning element.

13. The blade of claim 1 wherein the blade is integrally attached to the shaft.

14. The blade of claim 1 wherein the blade is detachable from the shaft.

15. A blade for a hockey stick, the blade comprising:
a toe portion;
a heel portion;
a cavity; and
an intermediate portion between the toe portion and the heel portion of the blade in a longitudinal direction of the blade;
wherein the blade comprises a tuning element disposed at least in the intermediate portion of the blade;
wherein the tuning element is positioned on a core element;
wherein the tuning element extends in a longitudinal direction of the blade; and
wherein the tuning element is a flat metal panel oriented at an angle of 30° to 45° relative to a longitudinal direction of the hockey-stick blade.

16. The blade of claim 15 wherein the blade is integrally attached to the shaft.

17. The blade of claim 15 wherein the blade is detachable from the shaft.

18. A hockey stick, comprising:
a shaft having a first flex;
a blade attached to the shaft, the blade comprising:
a front-facing wall attached to a rear-facing wall, with a cavity defined between the front-facing and rear-facing walls;
at least one core element in the cavity; and
at least one tuning element positioned on the at least one core element and entirely between the at least one core element and one of the front facing wall or the rear facing wall;
wherein the at least one tuning element stiffens the blade to give the blade a second flex; and
wherein the tuning element is a metal panel.

* * * * *